US010343189B2

(12) United States Patent
Garabedian et al.

(10) Patent No.: US 10,343,189 B2
(45) Date of Patent: Jul. 9, 2019

(54) MULTI STAGE AIR CLEANING MACHINE

(71) Applicant: Garabedian Bros. Inc., Fresno, CA (US)

(72) Inventors: Michael Garabedian, Fresno, CA (US); Michael Emerzian, Fresno, CA (US)

(73) Assignee: GARABEDIAN BROS., INC., Fresno, CA (US)

( * ) Notice: Subject to any disclaimer, the term of this patent is extended or adjusted under 35 U.S.C. 154(b) by 0 days.

(21) Appl. No.: 15/693,260

(22) Filed: Aug. 31, 2017

(65) Prior Publication Data

US 2019/0060956 A1 Feb. 28, 2019

(51) Int. Cl.

| | |
|---|---|
| ***B07B 1/00*** | (2006.01) |
| ***B07B 1/10*** | (2006.01) |
| ***B07B 9/02*** | (2006.01) |
| ***B07B 4/02*** | (2006.01) |
| ***B07B 4/08*** | (2006.01) |

(52) U.S. Cl.

CPC ..... *B07B 9/02* (2013.01); *B07B 1/00* (2013.01); *B07B 4/02* (2013.01); *B07B 4/08* (2013.01); *B07B 1/10* (2013.01)

(58) Field of Classification Search

CPC .... B07B 1/00; B07B 1/10; B07B 4/02; B07B 9/02

USPC ..... 209/139.1, 142

See application file for complete search history.

(56) References Cited

U.S. PATENT DOCUMENTS

| | | | | | |
|---|---|---|---|---|---|
| 1,834,981 | A * | 12/1931 | Stebbins | B07B 7/04 | 209/135 |
| 4,210,527 | A * | 7/1980 | Paterson | B07B 4/06 | 198/369.7 |
| 4,778,061 | A * | 10/1988 | Williams | B03B 9/06 | 209/137 |
| 5,579,920 | A * | 12/1996 | Garabedian | B07B 4/02 | 209/139.1 |
| 6,170,768 | B1 * | 1/2001 | Harmon | B65G 53/14 | 241/39 |
| 7,104,403 | B1 * | 9/2006 | Stephens | B07B 7/04 | 209/132 |
| 8,627,960 | B2 * | 1/2014 | Valerio | B07B 7/01 | 209/139.1 |
| 2003/0047076 | A1 * | 3/2003 | Liu | B07B 1/00 | 95/282 |
| 2005/0139701 | A1 * | 6/2005 | Naka | B02C 23/10 | 241/5 |
| 2009/0260541 | A1 * | 10/2009 | Kragten | C09D 5/031 | 106/439 |
| 2011/0024334 | A1 * | 2/2011 | Althouse | B07B 4/02 | 209/139.1 |

* cited by examiner

*Primary Examiner* — Terrell H Matthews

(74) *Attorney, Agent, or Firm* — Kilpatrick Townsend & Stockton LLP

(57) ABSTRACT

An assembly for cleaning material from a flowable product includes multiple stages of air cleaning for a product. Each air cleaning stage includes a vertical air column, an air knife, and at least one airlock. After introducing a product into the air column, the air knife disturbs material from the product and the material is carried away by the vertical air column. The airlock prevents significant disturbance of the vertical air column during operation. The cleaned product is delivered after a single cycle through the assembly having passed through several stages of cleaning.

19 Claims, 3 Drawing Sheets

104
136
134
140
120
119
142
122
128
138
131

MULTI STAGE AIR CLEANING MACHINE

BACKGROUND

Many products, particularly, to include, but not limited to agricultural products such as raisins, dates, almonds, walnuts, and pistachios require cleaning to separate lighter components (at times determined to be debris or undesirable) from heavier components. Because the heavier components are generally the desired final product and the lighter products or debris are often undesirable, cleaning is often carried out using airflow. A common approach is to provide an airflow and to pass product through the airflow to remove lighter product, which is carried away by the airflow, leaving behind a cleaned product.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
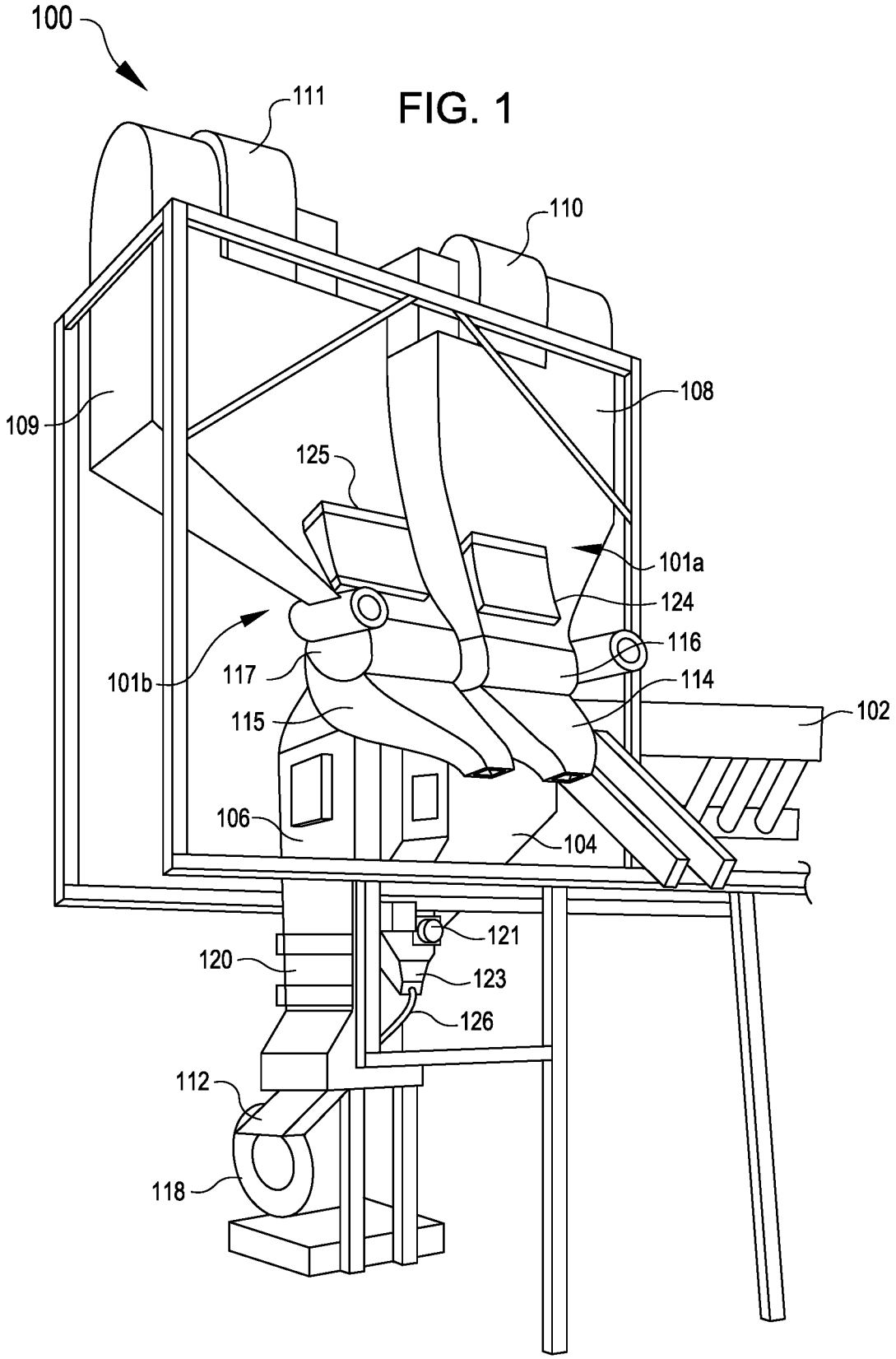
FIG. 1 is an axonometric projection of a two-stage cleaning machine according to certain aspects of the present disclosure.

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this description. In the following description, various examples will be described. For purposes of explanation, specific configurations and details are set forth in order to provide a thorough understanding of the examples. However, it will also be apparent to one skilled in the art that the examples may be practiced without the specific details. Furthermore, well-known features may be omitted or simplified in order not to obscure the example being described.

An air cleaning machine uses a directed jet of air to disturb or drive foreign matter, so long as it is lighter than the surrounding product, to the top of a flow of material and ideally drives the foreign matter airborne. Once the foreign matter is either airborne or removed to the top of a flowing or avalanching product, a directed air flow lifts the matter and deposits it in a settling or gathering chamber for removal from the system. An example air cleaning machine is described in U.S. Pat. No. 5,579,920, owned by the assignee of the present disclosure.

Certain aspects and features of the present disclosure relate to an apparatus and method of use for an air cleaning machine. The present disclosure relates to a machine and a method for cleaning products using multiple stages of air cleaners in a single machine as opposed to prior art, multiple air cleaning machines on separate lines, or prior art multiple passes through a single air cleaning machine. The air cleaning machine includes multiple stages of air cleaners for removing debris or other foreign material with a lighter bulk density/weight from a product with a heavier bulk density/ weight, especially in an agricultural product. A single pass through a prior art air cleaning machine having a single air cleaner may produce a clean product, but may still leave foreign matter or debris behind. In order to remove this additional/leftover debris, embodiments herein provide a second stage of cleaning via an additional air cleaner, set at the same or different air setting to greatly enhancing foreign matter and debris removal, and limiting or eliminating the need to purchase a separate machine for additional processing or to re-cycle the product through the single stage, prior art air cleaning machine again. Thus, the present air cleaning machine, having multiple air cleaner and the variable air velocity adjustability, reduces cost and expense, especially related to processing time and machine cost. By having a single machine with multiple stages of air cleaners for cleaning the product, a user can achieve the same result but at a much lower cost and in considerably less processing time. In addition, the air cleaner of the present disclosure, by using multiple stages of air cleaners, provides a greatly reduced footprint compared to having two or more separate machines.

While the machine and method may be particularly useful for agricultural products, the invention can be used for sorting or separating a wide range of components of other materials in which one component is more easily carried or entrained within an airflow than the other based on the varying/different bulk densities. Typically the component that is more easily entrained is lighter than the other component, but this system may also be useful for separating objects of significantly different geometry as well, therefore, the component that is carried up an air leg of an air cleaner and separated need not necessarily be lighter than the remaining product. In addition, the desired product can be the lighter product that is moved to the top of the air cleaner.

Embodiments of the present disclosure include an air cleaning machine for separating debris or cleaning a product as well as a method for use of the machine. The air cleaning machine uses multiple stages of air cleaners to produce a purer, cleaner final product. The multiple stage air cleaning machine may be described as an "air cleaning machine" because it uses air and more specifically air flow for cleaning the product. Similarly, each of the air cleaning stages, or air cleaners at each stage, utilizes air flow for cleaning the product. Each air cleaner of the air cleaning machine uses an air knife to produce a narrow, low volume high velocity stream of air that is directed upwards through a flowable product as the product passes by. The air knife facilitates separation of matter or debris from the flowable product. Because the flowing product is typically more dense than the debris to be removed, the debris is removed from the stream of product as it passes over the air knife. The stream of debris and the stream of cleaned product are then directed down different channels.

Turning now to a particular example, an air cleaning machine begins processing with an inlet device, which can include a shaker table, or other such sorting device to remove foreign matter. The inlet device leads to the first air cleaner, which provides the first stage of the cleaning portion. The product flow first passes through an airlock into an air leg. The air leg is typically a chimney type column with an airflow directed upwards towards the top of the air leg. The airlock allows the product to be fed continuously or semi-continuously through the machine without disturbing the airflow within the air leg. An angled or inclined section of the air leg sits beneath the airlock such that the flowing or avalanching products pass over the incline after entering the air leg. Located beneath the inclined section is an air jet, such as an air knife or other directional jet. Just past the air jet is an air intake, such as a screen, for allowing airflow upward through the product towards an upper part of the air leg. At the bottom of the inclined portion, below the exit of the air jet, is a second airlock, which allows the flowing products to transition to a second air leg for a second air cleaner. The second air cleaner provides the second stage of cleaning for the cleaning machine. This second air leg can be substantially the same as the first air leg, and can have a variable or different air flow setting/characteristic or the same air flow setting/characteristic. The difference or potential difference in air flow is a main reason for the second airlock, to keep the air flow in each leg separate and as undisturbed as possible. The flowing product passes over a second inclined portion within the second air leg, including a second air jet. Following the second air jet, the flowing product passes over an air intake, again which can be a screen, and then exits the machine through an opening at the bottom of the second air leg. The top of each air leg can includes a separate chamber where debris or foreign matter settles before being removed from the machine. The upper chambers may also include vacuum pumps or air outlets that cause the air flow through the air legs. There can be two separate vacuum units for each of the chambers, one each for each air leg, or the two air chambers can share a single vacuum unit, whereby valves or other control structures control flow through the separate chambers. The lighter debris or foreign material exits the upper chambers through an airlock to preserve the airflow in the air legs.

The airlocks used in the air cleaning machine permit the passage of material, such as products or debris or chaff, between two regions having different air pressure settings or air flow characteristics while minimizing the effect on the pressure or air flow between each region. Many commercially available airlock designs exist and may be suitable for the present invention. One particular example of an airlock design that may be useful in the present invention is a revolving or rotating door style airlock. These rotating door style airlocks are commonly referred to as "rotary airlocks" or "rotary valves." The operation of these rotating door style airlocks is similar to rotating doors at entrances to buildings: the rotating doors allow people to enter and exit the building with minimal air flow in and out of the building. Similarly, the rotating door airlocks allow product to flow between air legs or into or out of air legs, with minimal air flow or pressure changes between the two separate air legs. A motor or other driving device drives the rotary airlock. The rotary airlocks allow feeding and metering, or speed control, as a regular rotary feeding device does but also maintain pressure differences and a seal between product processing and conveying transitions. Rotary airlocks utilize a revolving door or valve with multiple sections. The design of the rotary airlock prevents a channel from existing directly between opposite ends of the airlock simultaneously. Rather, one end of the airlock is open to a first side of the airlock and material enters the airlock and as the rotating door revolves the section containing the material in the airlock is closed off from the first side and opened to a second side. Another exemplary alternative for the airlocks used in the system is a trickle valve. A trickle valve utilizes a duck bill shaped sleeve made of flexible material such as nitrile or any suitable rubber. The flexible sleeve allows a trickle of gravity discharge material while maintaining, or mostly maintaining, a pressure differential between two regions. Other forms of airlocks can be used.

Each of the air knives used in the air cleaning machine, or in different embodiments of the air cleaning machine, uses a directed jet of air to blow debris or lighter material from products that pass by. In some embodiments, the material flows over the air knife on a conveyor belt through which the air knife blows. In other embodiments, the air knife may not be stationary but may be a reciprocating air knife that passes the product to be cleaned. The air knife is connected to an air source, such as a blower or compressor. The air flow velocity may be adjusted either through use of a valve at the airflow or alternately by using a damper connected to the air source such as the blower, or by adjusting, up or down, the RPM of the air-knife blower. Multiple air knives may be used in different embodiments of the machine in each stage. For example, each stage may have a single air knife contained therein or may have multiple air knives set in series. When multiple air knives are used in the machine, there may either be multiple air sources, such as an individual air source for each air knife, or a single air source with dampers and ducting connecting to each of the air knives in the machine. In an embodiment with a single air source, the ducting may incorporate dampers so that the air flow to each air knife can be regulated. In this manner, the air flow at each air knife can be altered, even with a single air source, which may be desired when trying to remove different sizes or types of debris from the product. In one embodiment a first air knife within a first air cleaner may have a higher flow volume and velocity than a second air knife in a second air cleaner in order to remove heavier debris in the first or primary stage. The second air knife can be fine-tuned to remove a particular type of lighter debris in the second stage which consistently passes through the first stage. Alternately, the first air knife may have a lower air flow rate or velocity.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

Turning now to the figures, FIG. 1 illustrates an example air cleaning machine 100 that includes two air cleaners 101*a*, 101*b* for cleaning a product in a single pass. The machine 100 is fed by an infeed unit 102 which may be a conveyor belt delivering a product from either another process or from a delivery unit such as a harvesting truck. Alternatively, the infeed unit may be an additional sorting stage such as a shaker table with a porous table, or screen, through which debris, but not desirable product, may pass and be sorted away from the product flow to be dealt with independently. The shaker table vibrates either randomly or with a desired frequency to separate individual pieces and parts of the product as it flows towards the machine infeed unit, or entrance 102. The entrance 102 may also be equipped as a velocity control ramp whereby the speed of the product flow into the machine 100 may be regulated. One example of a velocity control is a conveyor belt which may be sped up or slowed down depending on processing needs and process requirements. Alternately, a sorting device, such as a shaker table or a feed ramp down which the products may slide, may be equipped to tilt or rotate in order to accelerate the flow of products down the table or ramp into the machine entrance 102.

The main body of the air cleaning machine 100 consists of two air legs 104, 106 that serve as conduits for air flow and products while in processing. The air legs 104, 106 can be made from any rigid material, though it is expected that they will primarily be formed from metal. The air legs 104, 106 may be assembled in sections similar to ductwork or other air handling channels. The air legs 104, 106 are shown as vertical columns having a rectangular cross section much like a chimney. Other cross-sections are contemplated, such as circular or elliptical, and may also be employed with other embodiments of the present invention. The first air leg 104 is in the first air cleaner 101*a*, which provides the first stage of air cleaning that the product passes through within the air cleaning machine 100. The air leg 104 is connected to a vacuum chamber 108 at the top of the air leg 104. The air leg 104 is connected, at a lower end to the second air leg 106. The second air leg 106 is attached to a vacuum chamber 109 at a top end and at a product exit 112 at a lower end. Thus, product flow through the air cleaning machine 100 starts at the entrance 102, flows into the air leg 104, then into the air leg 106, and out of the product exit 112.

One or more viewing windows 120 can be provided in the air legs 104, 106 through which a worker can inspect the performance of the air cleaning machine 100 by looking into the first air leg 104 or the second air leg 106 to observe debris removal. The viewing window 120 may be optionally openable such that larger debris may be removed or for maintenance on the internal portion of the air leg 104, 106.

The two vacuum chambers 108, 109 are situated atop the air legs 104, 106. The vacuum chambers 108 are each connected separately to the air legs 104, 106. In this configuration, vacuum chamber 108 is directly and fluidly connected with the first air leg 104 while the second vacuum chamber 109 is directly and fluidly connected with the second air leg 106. The connection between the air legs 104, 106 and the vacuum chambers 108 should be air tight to preserve the air flow within the air legs 104, 106. Each of the vacuum chambers 108 is connected with either a fan or a vacuum unit 110, 111 to generate an airflow from the air legs 104, 106 into the vacuum chambers 108, 109, respectively. In an alternative embodiment, there may be only one vacuum unit 110 connected to both of the chambers 108, 109. In a configuration with a single vacuum unit shared between the two chambers 108, 109, there may be ducting to connect the vacuum unit 110 to both of the chambers 108, 109, as well as dampers or other air controllers to control the air flow and level of vacuum in each of the chambers 108.

Each vacuum chamber 108, 109 also has a debris exit 114, 115 situated at the bottom of the chamber 108. To preserve the vacuum produced in each chamber 108, 109, the debris exit 114, 115 and the respective chamber 108, 109 are connected via an airlock 116, 117. The airlocks 116, 117 function to allow the debris to exit the vacuum chamber 108 without introducing appreciable amounts of air into the chamber 108 to disturb the vacuum level. Above the airlocks 116, 117, doors 124, 125 can be provided for access into the vacuum chamber 108 for removal of debris and maintenance should the need arise. The doors 124, 125 can also be used either as a viewing window if made of a sufficiently transparent material.

As previously described, the airlocks 116, 117 permit the passage of material, such as products or debris or chaff, between two regions having different pressure or air flow characteristics, while minimizing the effect on the pressure or air flow of each region. The airlocks 116, 117 are pictured in FIG. 1 at the product exits 114 of the vacuum chambers 108 to allow debris or chaff that has settled in the vacuum chamber to be removed and discarded. Additionally, an airlock 119 is used between the infeed unit 102 and the first air leg 104 (best shown in FIG. 2), and an airlock 121 is provided between the first air leg 104 and the second air leg 106.

Figure 2:
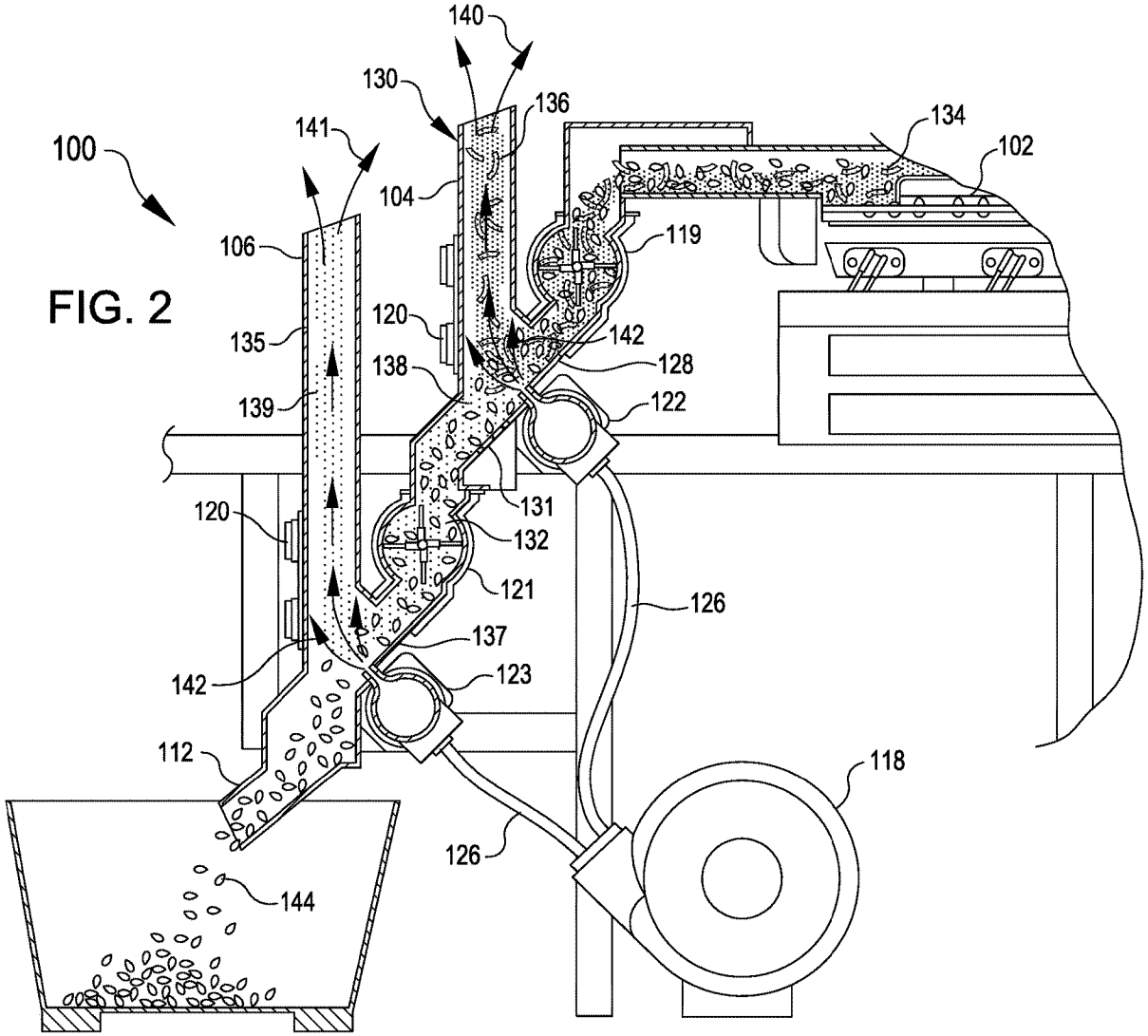
FIG. 2 is a cross-sectional view of the two-stage cleaning machine showing two stages for cleaning.

Located adjacent to each of the air legs 104, 106 are respective air knife assemblies 122, 123 (best shown in FIG. 2). The air knife assemblies 122, 123 are connected to the air legs 104, 106 and directed through openings in the air legs 104, 106. The openings (not pictured) are sealed around the air knives 122 such that the air flow inside the air legs 104, 106 is not disturbed. Each air knife 122, 123 is positioned below the respective airlocks 119, 121 at the entrance to the air legs 104, 106. Specifically, in FIG. 2, each of the air legs 104, 106 transitions from a vertical portion to a diagonal portion below the respective airlocks 119, 121. The product flows vertically downward into the respective airlock 119, 121, and flows out through the diagonal, or sloped portion discharge chute of the airlock due to gravity and rotation of the airlock doors. As an alternative, product can be conveyed through the air leg, for example by a screen conveyor. Each of the air knives 122, 123 is positioned within the diagonal portion of the air leg 104, 106 such that the jet of air is directed upwards through the products as the products flow through the diagonal portion, stirring the product and loosening the debris that is mixed into the product.

The air knife assemblies 122, 123 are each fluidly connected with an air source. In this example embodiment, the air source is pictured as a blower fan 118. The blower fan 118 is connected to each air knife 122, 123 by ducting 126. Incorporated within the ducting 126 are dampers (not shown) for controlling the air flow from the blower 118 to each air knife 122, 123. The dampers allow for individual control and fine tuning of air flow. This control and fine tuning allows the air cleaning machine 100 to be optimized for removal of debris from the product flow.

FIG. 2 illustrates a section view of a portion of the air cleaning machine 100 featuring the two stages involved in the cleaning process. The infeed unit 102 pictured shows a shaker table assembly with a pan for catching debris underneath the table. At the terminal end of the infeed unit 102, the infeed unit 102 is designed to deliver the product into the infeed airlock 119 for the first air leg 104. The infeed airlock 119 can be any airlock assembly described above, and as pictured, the infeed airlock is a rotary airlock or rotary valve.

Figure 3:
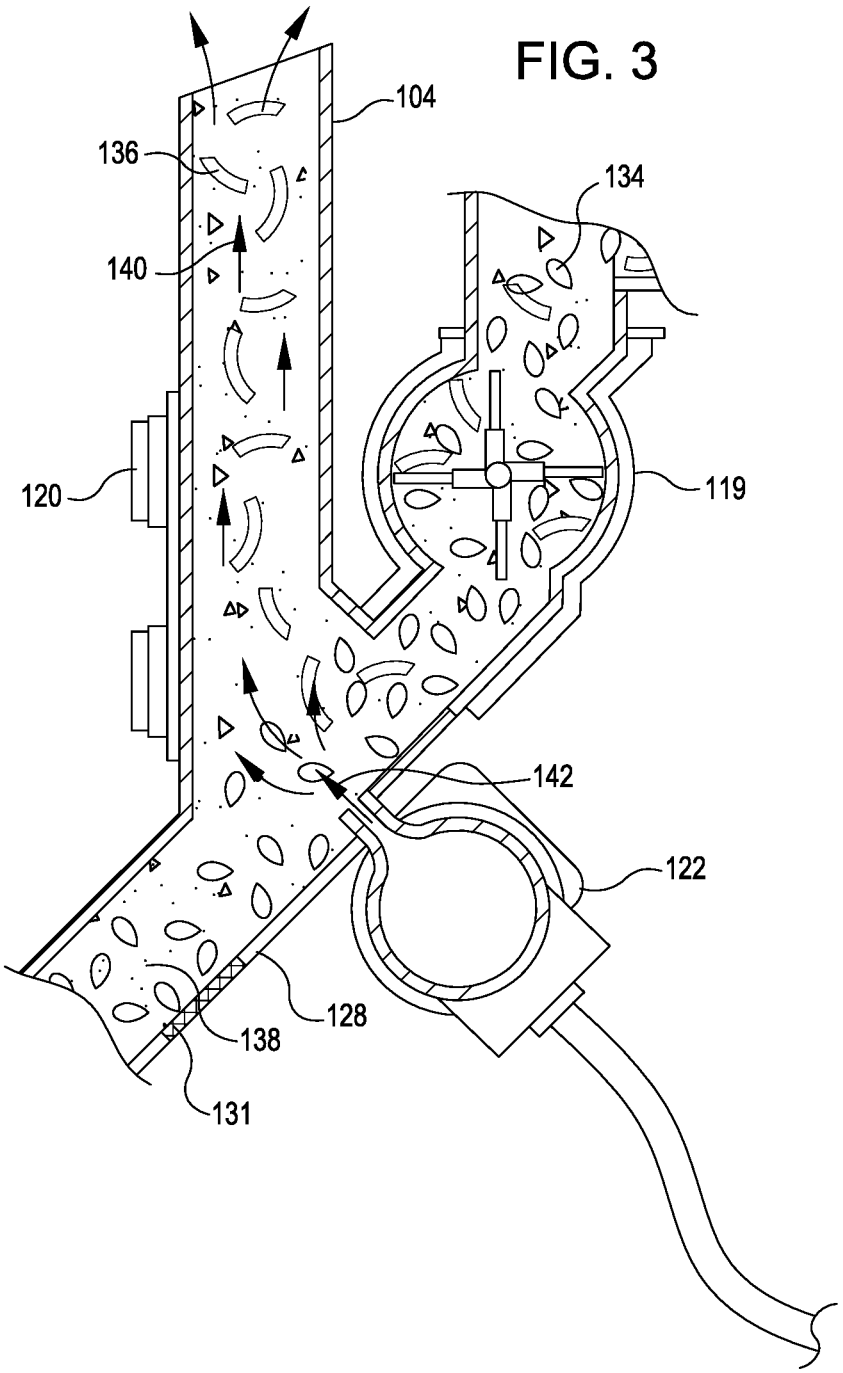
FIG. 3 is a detail view of an air knife and portion of an air leg.

The infeed airlock 119 is sealed, on the discharge end against the first air leg 104. The first air leg 104 has three main portions as shown in FIG. 1, a vertical conduit 130, a sorting surface 128, and an exit 132. An inlet 131, best shown in FIG. 3, is provided downstream of the air knife and within the air leg. The sorting surface is the chute running from the infeed airlock 119 to the exit 132. The inlet 131 is included on this surface. The vertical conduit 130 of the primary air leg 104 is a vertical chimney that extends upward from the sorting surface, opposite the air knife 122, into a bottom of the vacuum chamber 108. The product and debris are shaken loose and potentially blown upward into the vertical conduit 130 by the air knife 122. Immediately following this loosening of the material, the product flows over the inlet 131, where a strong flow of air flows upward as drawn by the vacuum unit 110 through the inlet. Desirably, the lighter debris continues into the vacuum chamber 108, and the heavier product (typically the desired product) continues to the exit 132. The vertical portion 130 must be long enough that desired product is not accidentally pulled up into the vacuum chamber 108. On one side of the vertical conduit 130 is the access or viewing door 120 as already described. The sorting surface 128 is pictured as a downwards sloping, or diagonal, section of the air leg 104. Other embodiments may include other variations or options for the sorting surface such as a perforated conveyor belt or a product screen which does not form a barrier to flow of the air knife 122 into the product. Located beneath the sorting surface 128 is the first air knife 122. The air knife 122 is connected to a blower 118 through ducting 126 as already described above. The air knife 122 is directed perpendicular to the sorting surface 128 in this embodiment, though other direction angles are anticipated as well. At the bottom-most end of the air leg 104 is the product exit 132 for the first air leg 104. This product exit 132 is a continuation of the sealed ducting comprising the entire air leg 104 and seals onto an entrance end of an airlock 123 positioned between the first air leg 104 and the second air leg 106.

The layout of the second air leg 106 is substantially the same as the first air leg 104, comprising a vertical conduit 135, a sorting surface 137, and the product exit 112, previously described. The second air knife 123 in the second air leg 106 is likewise positioned similarly to the layout of the first air leg 104. In some embodiments, the second air leg 106 may have a different configuration than the first air leg 104. For example, the air knife 123 within the second air leg may be positioned at a different angle relative to the sorting surface 137 or the sorting surface may be an alternative surface such as a conveyor belt or a product screen.

FIG. 2 also illustrates shows a product flow 134 entering the air cleaning machine 100. The mixed product and debris 134 enters the air cleaning machine 100 at the infeed unit 102 and may undergo some initial processing or sorting if the infeed unit 102 is configured to do so. From the infeed unit 102 the mixed product flow 134 travels into the first airlock 119 which introduces the mixed product 134 into the first air leg 104. Inside the air leg 104 the vacuum generator 110 and vacuum chamber 108 produce an airflow 140 from the inlet 131 to an upper part of the vacuum chamber 108. After the mixed product 134 enters the first air leg 104 the mixed product passes down or across the sorting surface 128. At a point along the sorting surface 128, the air knife 122 introduces a jet of air 142 into the air leg 104. As the mixed product 134 passes over the jet of air 142, lighter debris 136 and the desired product 138 are blown by the air knife 122 upward. The lighter debris 136 is kicked out of the mixed product 134 and made airborne. The airborne debris 136 may be carried up the air leg 104 by the airflow 140 into the vacuum chamber 108. The airborne debris 136 may then settle towards the debris exit airlock 116 where the debris 136 is removed from the air cleaning machine 100 to be disposed of.

After the debris 136 has been removed from the mixed product 134, the remainder of cleaned product 138 travels along the remainder of the sorting surface 128 towards the product exit 132 of the first air leg 132. The cleaned product 138 may still contain debris or other undesirable material to be cleaned away from the product 138. At the product exit 132 of the first air leg, the cleaned product enters an entrance side of the second airlock 121. As the cleaned product 138 exits the discharge side of the airlock 121 it is introduced into the second air leg 106. Inside the second air leg there may also be an airflow 141 as a result of a vacuum fan 111 and a vacuum chamber 109 at the top end of the air leg 106. The process inside the second air leg 106 is substantially the same as inside the first air leg 104. In this embodiment, the air knife 123 introduces a jet of air 142 into the second air leg 106 to sort debris 136 from the final product 144. One difference between the two stages or air legs 104, 106 in this embodiment is that the processing inside the second air leg 106 is performed on a pre-cleaned product 138 to remove additional material rather than an uncleansed initially mixed product 134. Also, an inlet, such as the inlet 131, may not be provided, as air can be drawn from the product exit 112. However, a separate inlet, such as the inlet 131 is typically provided because product can block the product exit 112, degrading airflow. After the second processing step, meaning after passing by the second air knife 123, a second portion of debris 139 is removed via the second chamber 109, and a final product 144 is delivered to the product exit 112 where it leaves the machine 100 and may be transported or delivered for further processing.

As can be understood, the machine of the present disclosure can be used to separate lighter product from heavier product, or even products of different densities or sizes. Although described herein with the desired product being heavier and exiting via the exit chute 112, a desired product could be the lighter product and could be collected in the vacuum chamber 108 and/or 109. To this end, the device 100 is a high efficient bulk density separator that has both booster and vacuum air that can be finitely adjusted through minute RPM/speed changes that make a difference on vacuum velocities to obtain the required separation of products. An example where a light product would be desired is where loose leaf spinach is deemed "accept" product and is lighter than the reject materials such as mice, snakes, sticks, mud balls, etc.

In addition, separation by the device or machine 100 is not limited to the food/agriculture industries, but can be used for any desired separate of items of different weight, sizes, or densities. As a non-limiting example, the air cleaning machine described herein could be used for removing debris/dirt from a glass recycling system, upstream of an electronic color sorter, that will separate clear, green, & brown glass. As another example, the air cleaning machine could be used for separating small (sub-standard) plastic parts from larger (standard) parts.

FIG. 3 illustrates a detail view of an air knife 122 within an air leg 104. The air knife 122 is positioned beneath the entrance airlock 119 and underneath the sorting surface 128. The mixed product 134 enters from the airlock 119 and travels along the sorting surface 128 until it reaches the air knife 122. The air knife 122 as shown in this detail view, disturbs the product flow 134 by injecting air 142 into the stream of products 134. The jet of air 142 may be perpendicular to the sorting surface 128, or may be positioned at any other suitable angle. The air flow 140 within the air leg 104 is capable of carrying the now airborne debris or chaff 136 away from the sorting surface 128 and up the vertical chimney 130 of the air leg 104. The cleaned portion of product 138 then travels further along the sorting surface for further processing within the machine 100. The combination of the air flow 140 and the jet of air 142 from the air knife 122 removes debris on the surface of the product flow 134 as well as any debris which may be partially or completely trapped under a portion of the product flow 134.

The infeed airlock 119 delivers the product into the air leg 101*a* and also stops or inhibits the incoming vacuum air from short cycling into the airstream "over the top" of the incoming product. In embodiments, it is desired that vacuum air enters primarily after the air knife so that the vacuum air can flow through the air knife-stirred product.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated examples thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims.

The use of the terms "a" and "an" and "the" and similar referents in the context of describing the disclosed examples (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. As used herein, the terms "top" and "bottom" can be associated with vertical positions when the air legs of the cleaning machine are oriented vertically. However, in some cases, the cleaning machine may use air legs or configurations in non-vertical directions, in in which case the terms "top" and "bottom" may refer to positions not vertical but oriented diagonally as well. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate examples of the disclosure and does not pose a limitation on the scope of the disclosure unless otherwise claimed. No language in the specification should be construed as indicating any non-claimed element as essential to the practice of the disclosure.

Preferred examples of this disclosure are described herein, including the best mode known to the inventors for carrying out the disclosure. Variations of those preferred examples may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An assembly for separating various products of different size, weights and/or bulk densities from a flowable product comprising:

a first air leg defining a first product entrance and a first product exit, and comprising a bottom end and a top end, a first air flow being directed from the bottom end of the first air leg towards a vacuum source at the top end of the first air leg;

a first airlock configured to introduce a product flow into the first product entrance;

a first air knife positioned between the first product entrance and the first product exit which directs a first air jet through the product flow and towards the top end of the first air leg whereby a first portion of light material is carried towards the top end of the first air leg;

a first vacuum chamber for removing the first portion of light material from the top end of the first air leg, the first vacuum chamber comprising:

an exhaust fan configured to produce the vacuum source; and a discharge airlock at a lower portion of the first vacuum chamber configured to remove the first portion of light material from the first vacuum chamber;

a second air leg defining a second product entrance and a second product exit, wherein the second air leg has a bottom end and a top end, a second air flow being directed from the bottom end of the second air leg towards the top end of the second air leg;

a second airlock connecting the first product exit to the second product entrance;

a second air knife positioned between the second product entrance and the second product exit which directs a second air jet through the product flow and towards the top end of the second air leg whereby a second portion of light material is carried towards the top end of the second air leg; and a second vacuum chamber for removing the second portion of light material from the top end of the second air leg.

2. The assembly of claim 1, wherein the first air jet has a different flow volume/velocity setting than the second air jet.

3. The assembly of claim 1, wherein the product flow passes through a delivery unit configured to control a velocity of the product flow into the first airlock.

4. A system comprising:

at least two processing units connected together configured to remove a plurality of light product from a product flow, each processing unit in the at least two processing units comprising:

(i) a chamber with an air flow generated by a vacuum source being directed from a bottom end to a top end;

(ii) a light product conduit extending from the top end of the chamber, with the air flow traveling towards the vacuum source located at a top end of the light product conduit, wherein the plurality of light product is carried through the light product conduit by the air flow;

(iii) a light product removal discharge airlock configured to remove the plurality of light product from the light product conduit;

(iv) an entrance airlock configured to introduce a product flow into the chamber;

(v) a product exit situated such that the product flow travels from the entrance airlock to the product exit;

(vi) an air knife situated between the entrance airlock and the product exit and configured to direct a jet of air through the product flow; and wherein the at least two processing units are arranged in series with the product exit of an earlier processing unit configured to deliver the product flow to the entrance airlock of a later processing unit.

5. The system of claim 4 comprising three processing units arranged in series with the product exit of a first processing unit configured to deliver the product flow to the entrance airlock of a second processing unit and the product exit of the second processing unit configured to deliver the product flow to the entrance airlock of a third processing unit.

6. The system of claim 4, wherein the product exit of an earlier processing unit is in fluid communication with the entrance airlock of a later processing unit.

7. The system of claim 4, wherein the product flow travels from the entrance airlock to the product exit over a screen through which a portion of smaller light product may pass.

8. The system of claim 7, wherein the plurality of light product is removed from the chamber through an opening separate from the product exit.

9. The system of claim 4, wherein a velocity of the product flow is controlled by a delivery unit prior to entering the entrance airlock.

10. A method for separating a portion of a product, the method comprising:

providing a first air flow within a first air leg from a bottom end of the first air leg to a top end of the first air leg, the first air flow generated at least in part by a vacuum source;

introducing, by an airlock, a product flow into the first air leg;

injecting a first directional jet of air through the product flow within the first air leg to separate a first portion of the product flow;

transferring, by a second airlock, the product flow from the first air leg to a second air leg;

providing a second air flow within the second air leg from a bottom end of the second air leg to a top end of the second air leg, the second air flow generated at least in part by the vacuum source;

injecting a second directional jet of air through the product flow within the second air leg to separate a second portion of the product flow; and removing the first portion of the product flow and the second portion of the product flow from the vacuum source through a removal airlock.

11. The method of claim 10 further comprising sorting the product flow with a product screen prior to the introducing step.

12. The method of claim 10, wherein the second airlock is configured to prevent the first air flow from disrupting the second air flow and the second air flow from disrupting the second air flow.

13. The method of claim 10, wherein removing the first portion of the product flow comprises delivering, by the first air flow, the first portion of the product flow to the removal airlock.

14. The method of claim 13, wherein removing the second portion of the product flow comprises delivering, by the second air flow, the second portion of the product flow to the removal airlock.

15. The method of claim 10, wherein the first directional jet of air has a different flow volume than the second directional jet of air.

16. An assembly for separating various products of different size, weights and/or bulk densities from a flowable product comprising:

a first air leg defining a first product entrance and a first product exit, and comprising a bottom end and a top end, a first air flow generated by a first vacuum source and being directed from the bottom end of the first air leg towards the top end of the first air leg;

a first air knife positioned between the first product entrance and the first product exit which directs a first air jet through the product flow and towards the top end of the first air leg whereby a first portion of light material is carried towards the top end of the first air leg;

a first vacuum chamber having a first product removal airlock for removing the first portion of light material from the top end of the first air leg;

a second air leg defining a second product entrance and a second product exit, wherein the second air leg has a bottom end and a top end, a second air flow generated by a second vacuum source and being directed from the bottom end of the second air leg towards the top end of the second air leg;

an airlock connecting the first product exit to the second product entrance;

a second air knife positioned between the second product entrance and the second product exit which directs a second air jet through the product flow and towards the top end of the second air leg whereby a second portion of light material is carried towards the top end of the second air leg; and a second vacuum chamber having a second product removal airlock for removing the second portion of light material from the top end of the second air leg.

17. The assembly of claim 16, wherein the first vacuum source comprises the second vacuum source.

18. The assembly of claim 1, wherein the first vacuum chamber comprises an exhaust fan which generates a vacuum within the first vacuum chamber.

19. The assembly of claim 1, wherein the first vacuum chamber and the second vacuum chamber are in fluid communication with each other.

* * * * *